US010349713B2

(12) United States Patent
Millen

(10) Patent No.: US 10,349,713 B2
(45) Date of Patent: Jul. 16, 2019

(54) TRAVEL LUGGAGE BAG

(71) Applicant: Denise Jacqueline Millen, Newmarket (CA)

(72) Inventor: Denise Jacqueline Millen, Newmarket (CA)

( * ) Notice: Subject to any disclaimer, the term of this patent is extended or adjusted under 35 U.S.C. 154(b) by 218 days.

(21) Appl. No.: 15/168,142

(22) Filed: May 30, 2016

(65) Prior Publication Data

US 2017/0340077 A1 Nov. 30, 2017

(51) Int. Cl.

| | |
|---|---|
| ***A45C 11/00*** | (2006.01) |
| ***A45C 7/00*** | (2006.01) |
| ***A45C 13/02*** | (2006.01) |
| ***A45C 13/03*** | (2006.01) |
| ***A45C 13/10*** | (2006.01) |

(52) U.S. Cl.

CPC ..... *A45C 7/0095* (2013.01); *A45C 7/00* (2013.01); *A45C 13/02* (2013.01); *A45C 13/03* (2013.01); *A45C 13/1069* (2013.01); *A45C 2007/0004* (2013.01); *A45C 2011/007* (2013.01)

(58) Field of Classification Search

CPC .. A45C 13/02; A45C 3/00; A45C 5/00; A45C 3/02; A45C 3/004; A45C 7/0095

USPC ..... 190/110, 109, 100, 107, 111; 206/278, 206/279, 284, 320, 38, 459.5

See application file for complete search history.

(56) References Cited

U.S. PATENT DOCUMENTS 2,764,201 A 9/1956 Whippo
4,966,260 A * 10/1990 Young ..... A45C 7/0059 150/117
5,329,947 A 7/1994 Shikler
5,779,033 A * 7/1998 Roegner ..... A45C 11/16 206/6.1
6,196,718 B1 3/2001 Dechant
8,567,578 B2 * 10/2013 Cuong ..... A45C 3/02 190/100
2003/0221978 A1 * 12/2003 Redzisz ..... A45C 11/00 206/278
2005/0016808 A1 * 1/2005 Sapyta ..... A45C 7/0054 190/107
2005/0224304 A1 * 10/2005 Bhavnani ..... A45C 7/0077 190/107
2006/0086628 A1 4/2006 Deutschendorf et al.
(Continued)

FOREIGN PATENT DOCUMENTS

CN 2867978 2/2007
CN 201846983 6/2011
(Continued)

OTHER PUBLICATIONS

Nicolas, Extended European Search Report for EP17172330, dated Sep. 11, 2017.

*Primary Examiner* — Fenn C Mathew
*Assistant Examiner* — Cynthia F Collado
(74) *Attorney, Agent, or Firm* — KA Filing LLC; Wayne V. Harper

(57) ABSTRACT

An apparatus includes a travel luggage bag. The travel luggage bag includes an elongated flexible foldable panel having spaced-apart elongated lateral panel sides. Spaced-apart flexible containers are permanently attached, at least in part, to the elongated flexible foldable panel. The spaced-apart flexible containers are configured to receive and securely store a personal travel item, such as a cosmetics item and/or a clothing item.

18 Claims, 13 Drawing Sheets

(56) References Cited

U.S. PATENT DOCUMENTS

| | | | | |
|---|---|---|---|---|
| 2009/0014267 | A1 | 1/2009 | Day | |
| 2009/0127045 | A1 | 5/2009 | Williams et al. | |
| 2014/0262851 | A1* | 9/2014 | Adler | A45C 7/0095<br>206/38 |
| 2014/0352858 | A1 | 12/2014 | Dewitt | |
| 2014/0374302 | A1 | 12/2014 | Godshaw et al. | |
| 2016/0219997 | A1* | 8/2016 | Collins | A45C 7/0036 |

FOREIGN PATENT DOCUMENTS

| | | | | |
|---|---|---|---|---|
| CN | 202603901 | | 12/2012 | |
| CN | 203314350 | | 12/2013 | |
| DE | 29519332 | U1 * | 1/1996 | A45C 3/00 |
| DE | 202009017553 | | 4/2010 | |
| EP | 0281478 | A2 * | 9/1988 | A45C 7/0095 |
| WO | 95/24839 | | 9/1995 | |
| WO | 0062639 | | 10/2000 | |

* cited by examiner

TRAVEL LUGGAGE BAG

TECHNICAL FIELD

This document relates to the technical field of (and is not limited to) a travel luggage bag (and method therefor).

BACKGROUND

Baggage or luggage includes bags, cases, and containers that hold a traveler's articles during transit. The modern traveler may be expected to have luggage containing clothing, toiletries, small possessions, trip necessities, etc.

SUMMARY

It will be appreciated that there exists a need to mitigate (at least in part) at least one problem associated with the existing luggage (also called the existing technology). After much study of the known systems and methods with experimentation, an understanding of the problem and its solution has been identified and is articulated as follows:

For instance, a problem (selected from amongst many problems) with the existing luggage systems is that the user needs to open the luggage and then dig into the interior of the luggage and sort out the contents of the luggage.

What is needed is a travel luggage bag in which the user may store the items in a convenient and/or logical arrangement.

To mitigate, at least in part, at least one problem associated with the existing technology, there is provided (in accordance with a major aspect) an apparatus.

The apparatus includes a travel luggage bag. The travel luggage bag includes an elongated flexible foldable panel. Spaced-apart flexible containers are permanently attached, at least in part, to the elongated flexible foldable panel. A panel closure is fixedly attached to the elongated flexible foldable panel. The panel closure is configured to secure the elongated flexible foldable panel. Each of the spaced-apart flexible containers have a container closure configured to securely close and open (in such a way that a personal travel item is securely held therein once received therein).

A technical advantage, amongst many, of the travel luggage bag is that the user may store items (travel items) in a convenient and/or logical arrangement.

To mitigate, at least in part, at least one problem associated with the existing technology, there is provided (in accordance with a major aspect) an apparatus.

The apparatus includes a travel luggage bag. The travel luggage bag includes an elongated flexible foldable panel having spaced-apart elongated lateral panel sides extending between spaced-apart panel end portions. The elongated rectangular flexible foldable panel includes an exterior surface and an interior surface. Spaced-apart flexible containers are permanently attached, at least in part, to the interior surface of the elongated flexible foldable panel. This is done in such a way that (A) the spaced-apart flexible containers are each positioned to extend between the spaced-apart elongated lateral panel sides, and (B) the spaced-apart flexible containers are positioned, one following after another, between the spaced-apart panel end portions. The spaced-apart flexible containers are configured to receive and securely store a travel item. The elongated flexible foldable panel is configured to be foldable. This is done in such a way that the elongated flexible foldable panel, in use, forms a stack having planar-extending folded panel sections in a closed non-rolled configuration, in which the spaced-apart flexible containers are user-inaccessible, and the exterior surface of the elongated rectangular flexible foldable panel is exposed while the interior surface of the elongated rectangular flexible foldable panel is concealed from viewing. The stack (having the planar-extending folded panel sections of the elongated flexible foldable panel) is unfolded (unfoldable) from the closed configuration to an open configuration. In the open configuration, the elongated flexible foldable panel is unfolded and expanded, in which the spaced-apart flexible containers are readily user-accessible. A panel closure is fixedly attached to the elongated flexible foldable panel. The panel closure is configured to secure the elongated flexible foldable panel in the closed configuration. The elongated flexible foldable panel has a length in the open configuration, in which the length of the elongated flexible foldable panel is reduced in the closed configuration. The spaced-apart flexible containers extend between the spaced-apart elongated lateral panel sides of the elongated flexible foldable panel. The spaced-apart flexible containers have opposite lateral container edges, in which the opposite lateral container edges are respectively fixedly joined, at least in part, to the spaced-apart elongated lateral panel sides of the elongated flexible foldable panel. Each of the spaced-apart flexible containers have a container closure configured to securely close and open (in such a way that the personal travel item is receivable therein once the elongated flexible foldable panel is placed in the open configuration, and the personal travel item is securely held therein once received therein).

Other aspects and features of the non-limiting embodiments may now become apparent to those skilled in the art upon review of the following detailed description of the non-limiting embodiments with the accompanying drawings.

This Summary is provided to introduce concepts in simplified form that are further described below in the Detailed Description. This Summary is not intended to identify key features or essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
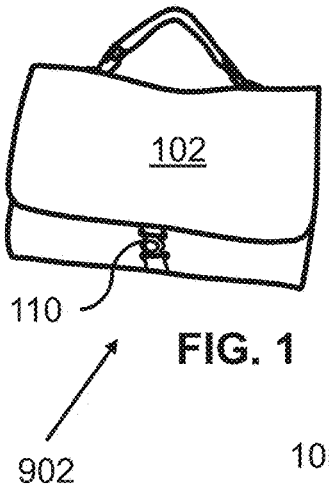
FIG. 1 depicts a front view of an embodiment of a travel luggage bag.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

Listing Of Reference Numerals Used In The Drawings

102 travel luggage bag
104 elongated flexible foldable panel, or panel
105 stack
106 spaced-apart elongated lateral panel sides
107 spaced-apart panel end portions
108 spaced-apart flexible containers, or containers
110 panel closure
111 interior surface
113 exterior surface
114 lateral container edges
115 item connector
116 container closure
118 viewing material
120 hanger mechanism
122 tooth brush
124 hair brush
126 backside pocket
128 box compartments
130 normally-closed sleeve compartment
132 normally-open sleeve compartment
134 divider portion
136 pivoting floor
138 brace member
140 handle
142 tether
144 auxiliary bag
146 elastic material
900 personal travel item, or travel item
902 closed configuration
904 open configuration

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts a front perspective view of an embodiment of an apparatus including (and not limited to) a travel luggage bag 102.

Referring to the embodiment as depicted in FIG. 1, the travel luggage bag 102 is depicted in a closed configuration 902. The travel luggage bag 102 may be conveniently utilized by frequent travelers. Preferably, the travel luggage bag 102 includes a panel closure 110 configured to securely close the travel luggage bag 102 in the closed configuration 902. This is done in such a way that items are not able to inadvertently fall from the travel luggage bag 102 (once the travel luggage bag 102 is securely closed). Preferably, the travel luggage bag 102 includes a handle 140. The panel closure 110 may include a magnet or mechanical clasp, etc.

A technical advantage, amongst many, of the travel luggage bag 102 is that the user may store personal travel items in a convenient and/or logical arrangement.

FIGS. 2-6 depict perspective views of embodiments of the travel luggage bag 102 of FIG. 1.

Referring to the embodiments as depicted in FIGS. 2-6, the travel luggage bag 102 includes (and is not limited to) a synergistic combination of an elongated flexible foldable panel 104 and spaced-apart flexible containers 108. Hereafter, the elongated flexible foldable panel 104 is referred to as the panel 104. Hereafter, the spaced-apart flexible containers 108 are referred to as the containers 108. The panel 104 includes, for instance, a flexible fabric material (also called a web or a webbing). The flexible fabric material may include any type of flexible material (natural or man-made, such as cotton, nylon, etc.). The panel 104 may be waterproof. The containers 108 include, for instance, a flexible fabric material (also called a web or a webbing) having any type of flexible material (natural or man-made, such as cotton, nylon, etc.). The containers 108 may be waterproof.

Figure 6:
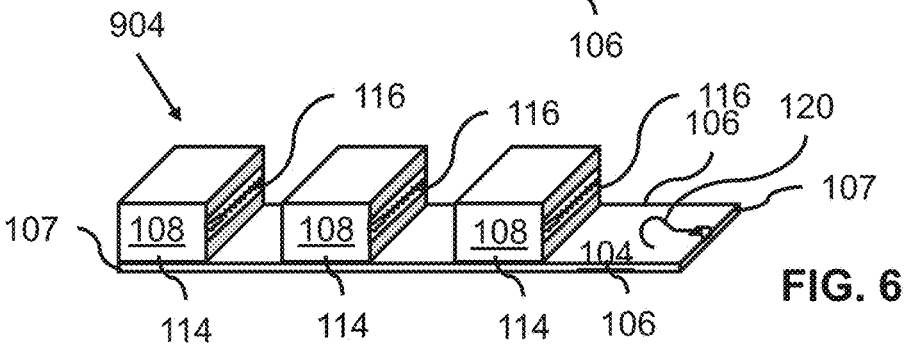
Figure 7:
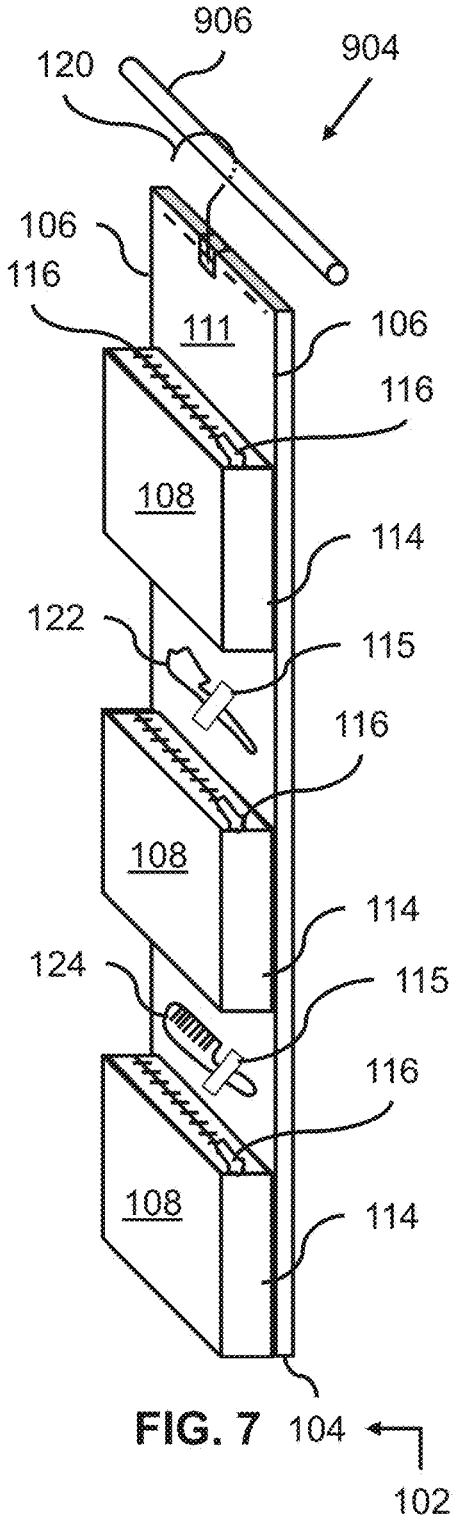
FIGS. 7-9 depict perspective views of embodiments of the travel luggage bag of FIG. 1.
Figure 8:
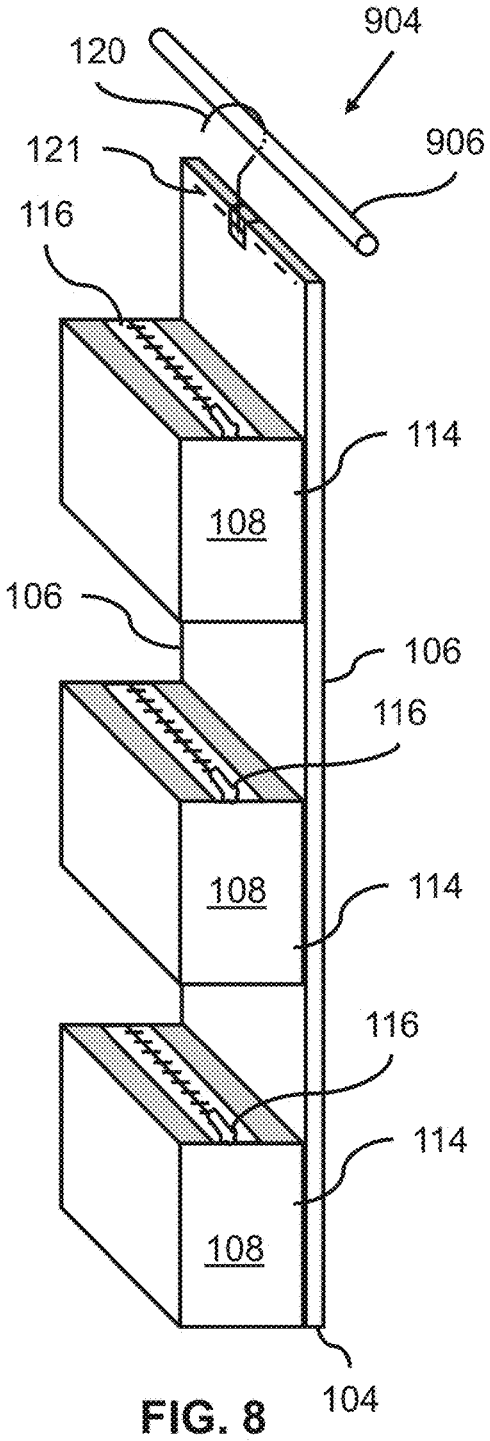

The panel 104 has spaced-apart elongated lateral panel sides 106 (as depicted in FIG. 6). Preferably, the panel 104 has spaced-apart elongated lateral panel sides 106 that extend between spaced-apart panel end portions 107 (as depicted in FIG. 6). More preferably, the panel 104 is continuous (and uninterrupted) between the spaced-apart panel end portions 107. More preferably, the panel 104 is rectangular shaped. Preferably, the panel 104 includes an exterior surface 113 (as depicted in FIG. 8), and an interior surface 111 (as depicted in FIG. 7).

Generally, the containers 108 are permanently attached (directly or indirectly), at least in part, to the elongated flexible foldable panel 104. Preferably, the containers 108 are permanently attached, at least in part, to the interior surface 111 of the elongated flexible foldable panel 104. The containers 108 are configured to receive and securely store a travel item 900, such as a cosmetics item and/or a clothing item. Preferably, the containers 108 are permanently attached, at least in part, to the elongated flexible foldable panel 104. This is done in such a way that (A) the containers 108 are each positioned to extend between the spaced-apart elongated lateral panel sides 106, and (B) the containers 108 are positioned, one following after another, between the spaced-apart panel end portions 107 (as depicted in FIG. 6).

Figure 2:
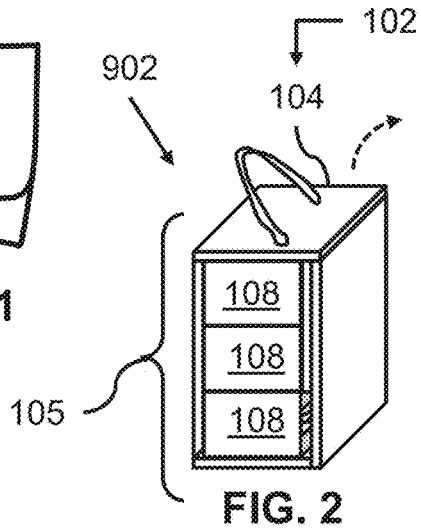
FIGS. 2-6 depict perspective views of embodiments of the travel luggage bag of FIG. 1.

The panel 104 is configured to be foldable (as depicted in FIG. 2). This is done in such a way that the elongated flexible foldable panel 104, in use, forms a stack 105 having folded panel sections in a closed configuration 902, in which the containers 108 are user-inaccessible (preferably, in which the containers 108 are not folded in the closed configuration 902). The stack 105 (having the folded panel sections of the elongated flexible foldable panel 104) is unfolded (unfoldable) from the closed configuration 902 (as depicted in FIG. 2) to an open configuration 904 (as depicted in FIG. 6). In the open configuration 904, the panel 104 is unfolded and expanded, in which the containers 108 are readily user-accessible (and preferably in which the containers 108 are unfolded). Preferably, in the closed configuration 902 (as depicted in FIG. 2), the exterior surface 113 of the panel 104 is exposed while the interior surface 111 of the panel 104 is concealed from viewing (by the user). Preferably, in the open configuration 904 (as depicted in FIG. 6), the exterior surface 113 of the panel 104 is exposed and the interior surface 111 of the panel 104 is also exposed (for viewing by the user).

Figure 3:
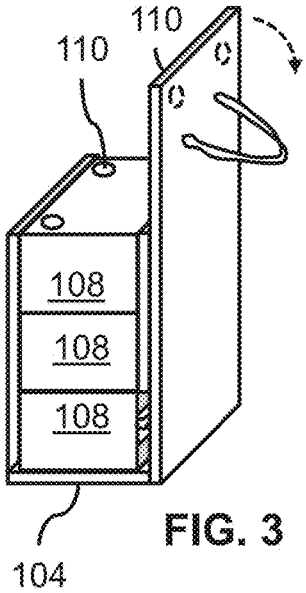

The panel 104 includes a panel closure 110 (as depicted in FIG. 3). The panel closure 110 is fixedly attached to the elongated flexible foldable panel 104. The panel closure 110 is configured to secure the panel 104 in the closed configuration 902. The panel 104 has a length in the open configuration 904 (as depicted in FIG. 6), in which the length of the panel 104 is reduced in the closed configuration 902 (as depicted in FIG. 2).

The containers 108 extend between the spaced-apart elongated lateral panel sides 106 of the panel 104 (as depicted in FIG. 6). The containers 108 have opposite lateral container edges 114 (as depicted in FIG. 6). The opposite lateral container edges 114 are respectively fixedly joined, at least in part, to the spaced-apart elongated lateral panel sides 106 of the elongated flexible foldable panel 104. Each of the containers 108 has a container closure 116 (as depicted in FIG. 6) configured to securely close and open. This is done in such a way that the travel item 900 is receivable therein once the panel 104 is placed in the open configuration 904, and the travel item 900 is securely held therein once received therein. The container closure 116 may include a zipper assembly, etc., touch fasteners, and/or any equivalent thereof.

In accordance with a preferred embodiment, a hanger mechanism 120 is connected to the elongated flexible foldable panel 104. The hanger mechanism 120 is configured to support vertical suspension of the elongated flexible foldable panel 104. The hanger mechanism 120 may include a metal or plastic material (any type of rigid material).

Referring to the embodiment as depicted in FIG. 2 (in which a side perspective view is depicted), the travel luggage bag 102 forms the stack 105.

Referring to the embodiment as depicted in FIG. 3 (in which a side perspective view is depicted), the travel luggage bag 102 is initially opened in part by disconnecting the panel closure 110.

Figure 4:
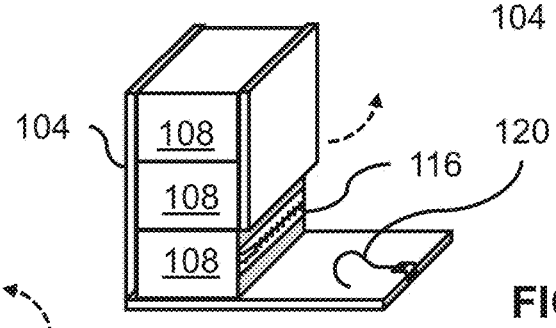

Referring to the embodiment as depicted in FIG. 4 (in which a side perspective view is depicted), the travel luggage bag 102 is further opened in part to reveal the hanger mechanism 120. The hanger mechanism 120 is configured to be received by a horizontally extending item (such as a shower curtain rod, etc.), as depicted in FIG. 7.

Figure 5:
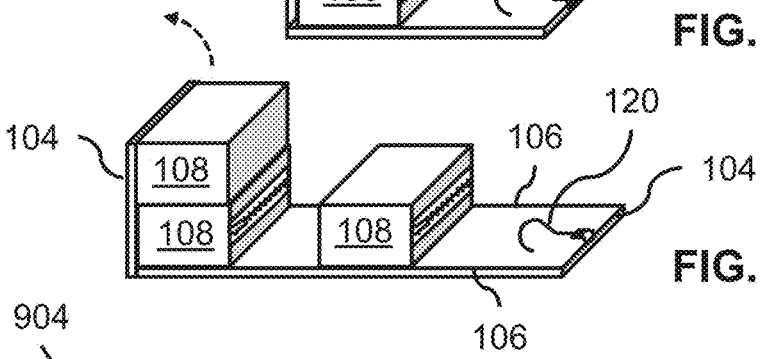

Referring to the embodiment as depicted in FIG. 5 (in which a side perspective view is depicted), the travel luggage bag 102 is further opened in part to reveal at least some of the containers 108.

Referring to the embodiment as depicted in FIG. 6 (in which a side perspective view is depicted), the travel luggage bag 102 is further opened in part to reveal all of the containers 108. A technical advantage, amongst many, of the travel luggage bag 102 is that the user may store personal travel items in a convenient and/or logical arrangement. Preferably, the length of the panel 104 is about 33 inches, with a width of about 13 inches. The height of the containers 108 is about 6 inches. There are preferably three rows of the containers 108.

Figure 9:
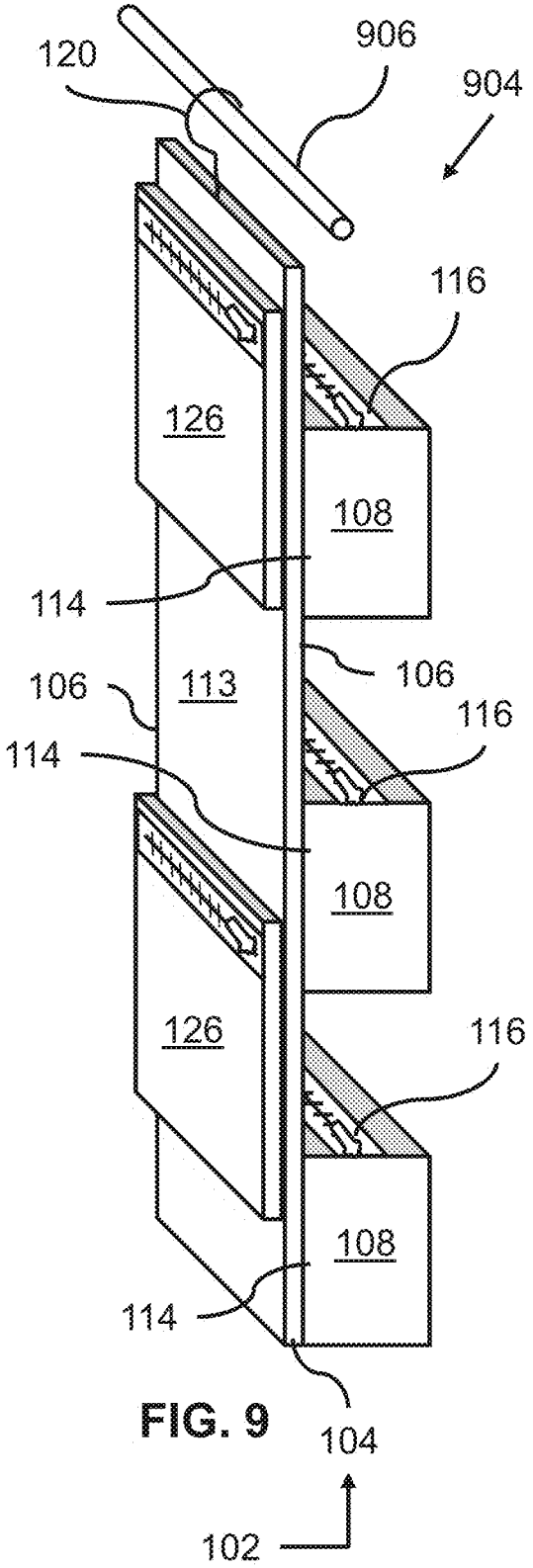

FIGS. 7-9 depict perspective views of embodiments of the travel luggage bag 102 of FIG. 1.

Referring to the embodiment as depicted in FIG. 7 (in which a front perspective view is depicted), the containers 108 are depicted in a collapsed state (empty). The containers 108 are configured to collapse (when items are removed from the containers 108 (as depicted in FIG. 7). Preferably, the hanger mechanism 120 is configured to be received by a horizontally extending item (such as a shower curtain rod, etc.).

The panel 104 includes an item connector 115 positioned on an inner surface of the panel 104 and is located between adjacently positioned instances of the container 108. The item connector 115 is configured to connect a tooth brush 122 or a hair brush 124 to the elongated flexible foldable panel 104. The item connector 115 includes, for instance, a flexible fabric material (also called a web or a webbing) having any type of flexible material (natural or man-made, such as cotton, nylon, etc.). The item connector 115 may be waterproof.

Referring to the embodiment as depicted in FIG. 8 (in which a front perspective view is depicted), the containers 108 are configured to expand (when items are inserted into the containers 108 (as depicted in FIG. 8). The travel luggage bag 102, preferably, includes a hanging toiletry bag. Preferably, the panel 104 is about 38 inches long (when hanging, as depicted in FIG. 8). It will be appreciated that there is enough room between the containers 108 for folding and closing the travel luggage bag 102 (as depicted in FIG. 2). A rod 121 is to be inserted into the panel 104, and the rod 121 is connected to the hanger mechanism 120. The rod 121 is configured to be rotated in the panel 104. The rod 121 may include a metal or plastic material (any type of rigid material).

Referring to the embodiment as depicted in FIG. 9, (in which a rear perspective view is depicted), the containers 108 include a backside pocket 126 positioned on the exterior surface 113 of the elongated flexible foldable panel 104. The backside pocket 126 is configured to hold clothing to be cleaned (laundry) or clean clothing. The containers 108 are in the expanded state (as depicted in FIG. 9).

Figure 10:
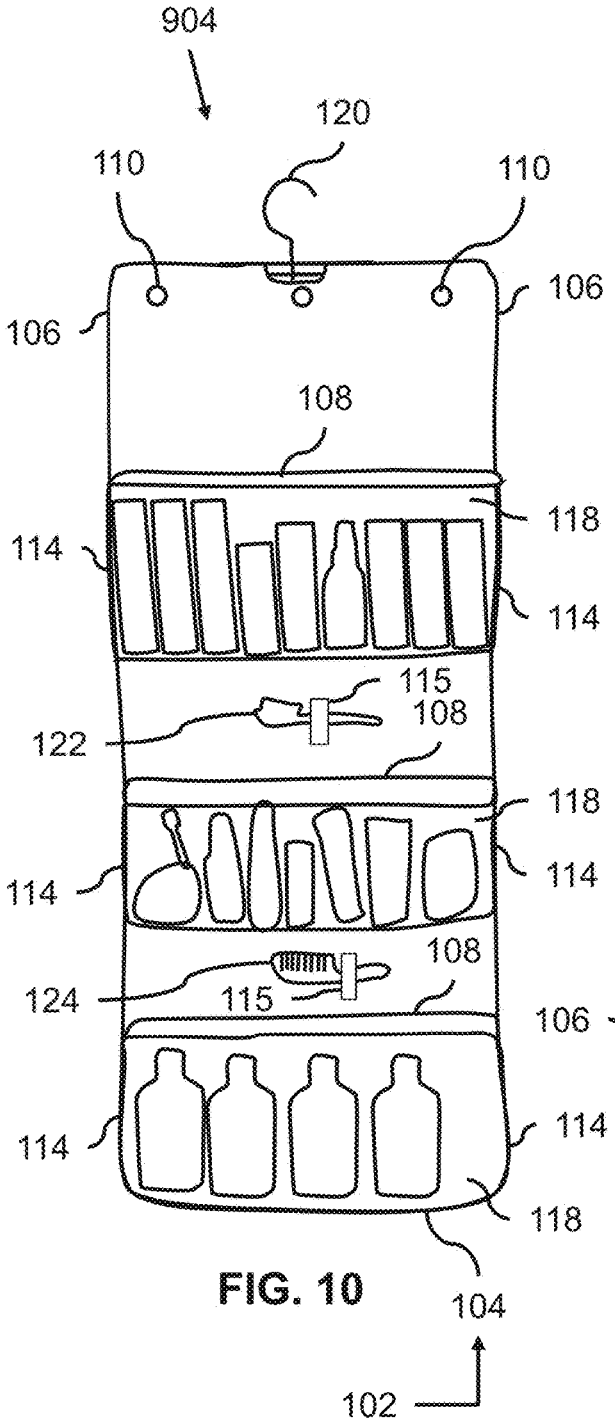
FIGS. 10-11 depict perspective views of embodiments of the travel luggage bag of FIG. 1.
Figure 11:
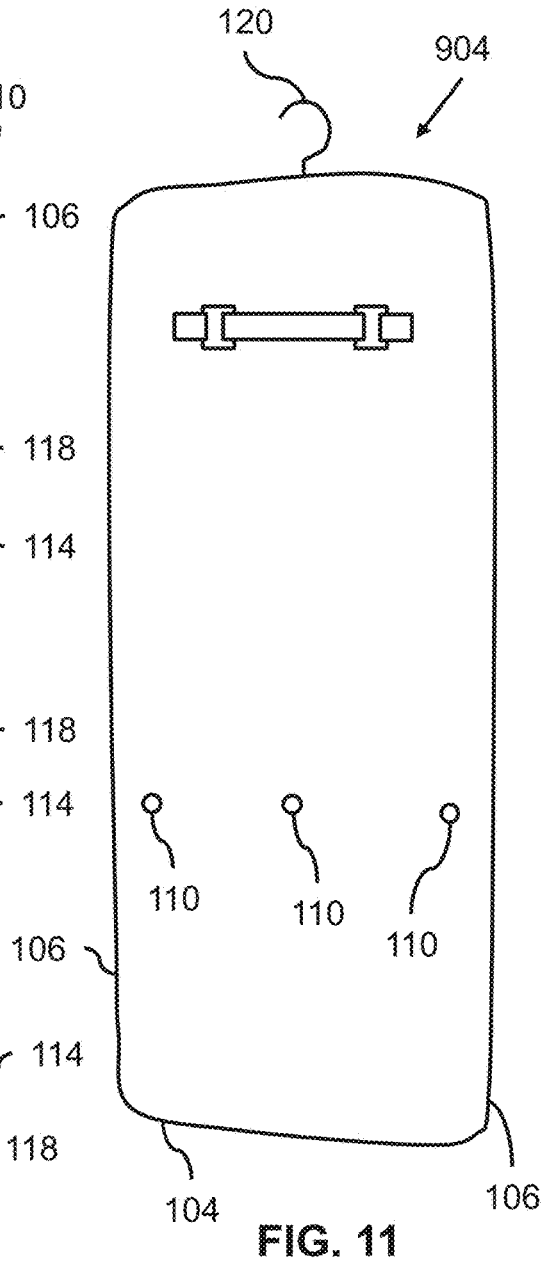

FIGS. 10-11 depict perspective views of embodiments of the travel luggage bag 102 of FIG. 1.

Referring to the embodiment as depicted in FIG. 10, the travel luggage bag 102, preferably, provides a hanging toiletry bag. The containers 108 include a viewing material 118 configured to permit internal viewing, at least in part, of the spaced-apart flexible containers 108. For instance, bottles or other items contained in the containers 108 are viewable by the user. A technical advantage, amongst many, of the travel luggage bag 102, with the viewing material 118, is that the user may view personal travel items contained in the travel luggage bag 102 once the travel luggage bag 102 is opened.

Preferably, the panel 104 includes a hanger mechanism 120. The hanger mechanism 120 is connected to the elongated flexible foldable panel 104. The hanger mechanism 120 is configured to support vertical suspension of the elongated flexible foldable panel 104.

The preferred length of the travel luggage bag 102 is about 17 inches in length (but other options may be possible for length). In accordance with the embodiment as depicted in FIG. 10, the containers 108 include a top container 108 (fixedly positioned at a top portion of the panel 104), a middle container 108 (fixedly positioned at a middle portion of the panel 104), and a bottom container 108 (fixedly positioned at a bottom portion of the panel 104) that are spaced apart from each other. Preferably, the material used in the travel luggage bag 102 and/or the containers 108 is waterproof.

Referring to the embodiment as depicted in FIG. 11 (in which a rear view is depicted), the travel luggage bag 102 has the panel closure 110 (such as a series of magnets) mounted on the rear side of the elongated flexible foldable panel 104. The magnets, mounted on the rear side of the panel 104, are configured to be magnetically attracted to the magnets mounted to the top portions of the panel 104 (as depicted in FIG. 10).

FIGS. 12-19 depict views of embodiments of the travel luggage bag 102 of FIG. 1.

Figure 12:
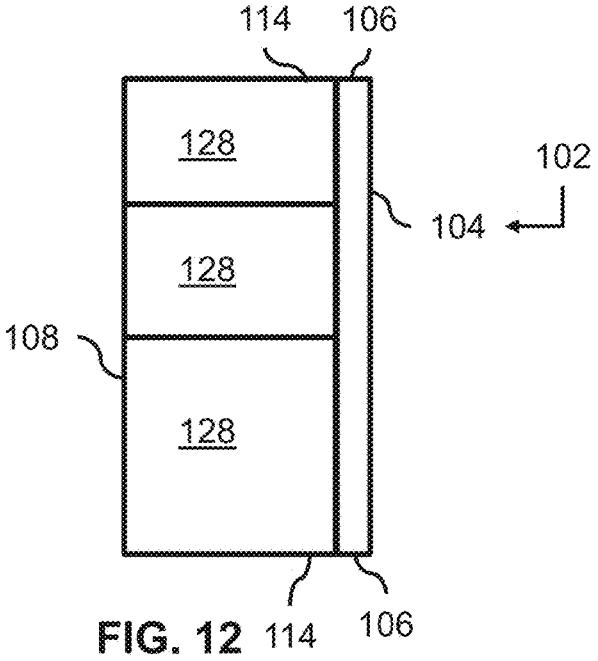
FIGS. 12-19 depict views of embodiments of the travel luggage bag of FIG. 1.

Referring to the embodiment as depicted in FIG. 12 (in which a top view is depicted), the container 108 includes box compartments 128 positioned in a row (the box compartments 128 are positioned along a vertically-aligned row). For instance, the container 108 (as depicted in FIG. 12) may be positioned at the top section of the panel 104 (as depicted in FIG. 10).

Figure 13:
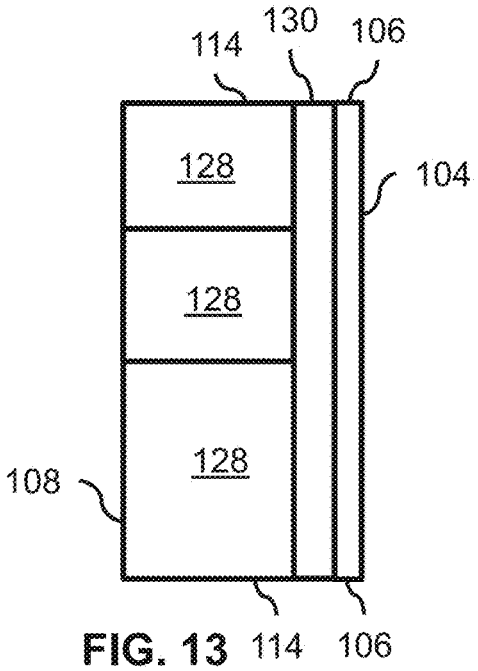

Referring to the embodiment as depicted in FIG. 13 (in which a top view is depicted), the container 108 includes the box compartments 128 positioned in a row (preferably relatively shorter than the box compartments 128, as depicted in FIG. 12). For instance, the container 108 (as depicted in FIG. 13) may be positioned at the middle section of the panel 104 (as depicted in FIG. 10). The container 108 also includes a normally-closed sleeve compartment 130 positioned adjacently to the box compartments 128. The normally-closed sleeve compartment 130 is positioned adjacently to the elongated flexible foldable panel 104. The normally-closed sleeve compartment 130 extends between the spaced-apart elongated lateral panel sides 106 of the elongated flexible foldable panel 104. The normally-closed sleeve compartment 130 has opposite flexible lateral sides that touch each other when no item is received in the normally-closed sleeve compartment 130.

Figure 14:
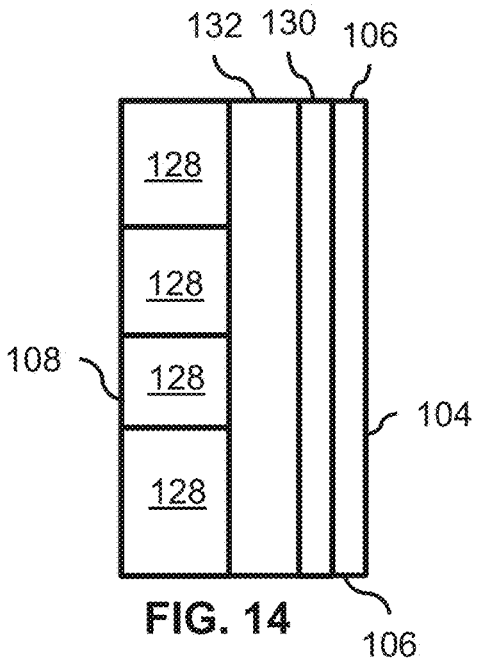

Referring to the embodiment as depicted in FIG. 14 (in which a top view is depicted), the container 108 includes the box compartments 128 positioned in a row (preferably, relatively shorter than the box compartments 128, as depicted in FIG. 13). For instance, the container 108 (as depicted in FIG. 14) may be positioned at the top section of the panel 104 (as depicted in FIG. 10). The container 108 also includes the normally-closed sleeve compartment 130 that is positioned adjacently to the elongated flexible foldable panel 104. The normally-closed sleeve compartment 130 extends between the spaced-apart elongated lateral panel sides 106 of the elongated flexible foldable panel 104. The normally-closed sleeve compartment 130 has opposite flexible lateral sides that touch each other when no item is received in the normally-closed sleeve compartment 130. The container 108 also includes a normally-open sleeve compartment 132 configured to remain normally open when the normally-open sleeve compartment 132 does not receive an item. The normally-open sleeve compartment 132 is positioned between the normally-closed sleeve compartment 130 and the box compartments 128. Preferably, the normally-open sleeve compartment 132 includes flexible material. The normally-open sleeve compartment 132 extends between the spaced-apart elongated lateral panel sides 106 of the elongated flexible foldable panel 104. Preferably, the box compartments 128 may be called viewable containers (the contents of the box compartments 128 are user-viewable) without having to open the box compartments 128. It will be appreciated that the normally-closed sleeve compartment 130 (also called a hidden pocket) may be utilized for the storage of flat items or products, such as bandages and scissors, nail files, etc. Some of the containers 108 may be strategically utilized for storage of shampoo bottles, a toothbrush and a tube of toothpaste, etc.

Figure 15:
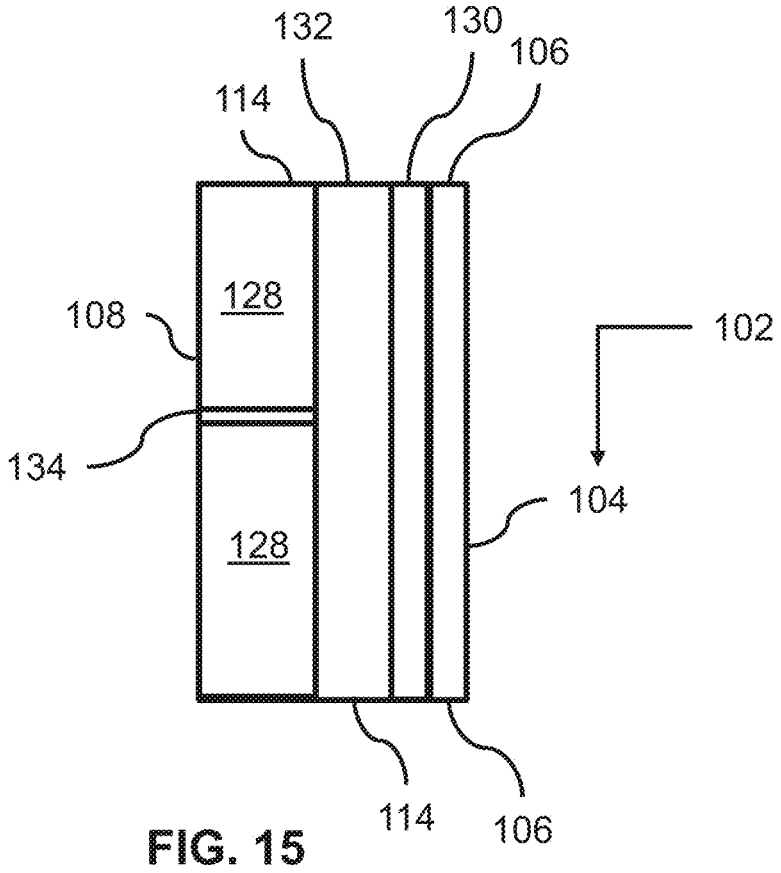
Figure 16:
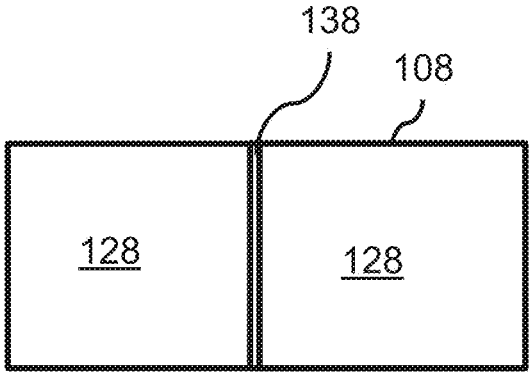

Referring to the embodiment as depicted in FIGS. 15 and 16 (in which a top view and a front view, respectively, are depicted), the container 108 further includes a divider portion 134 positioned between adjacent instances of the box compartments 128. This arrangement provides improved organization of items to be stored in the box compartments 128. The divider portion 134 is configured to provide a barrier between adjacent instances of the box compartments 128 (and to prevent mixing of items between the adjacent instances of the box compartments 128). In accordance with an option, the divider portion 134 is positioned in at least one of the containers 108.

Figure 17:
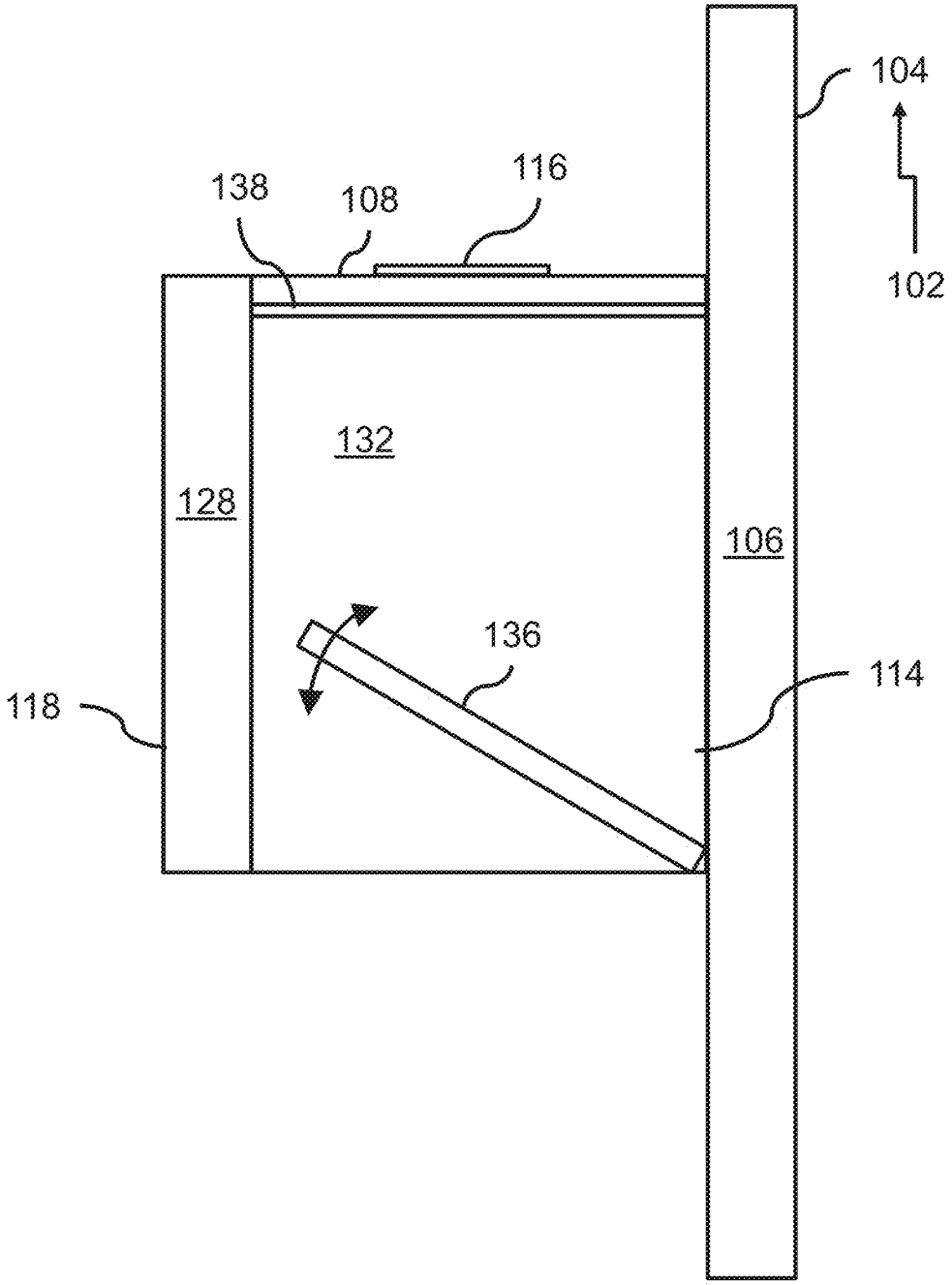
Figure 18:
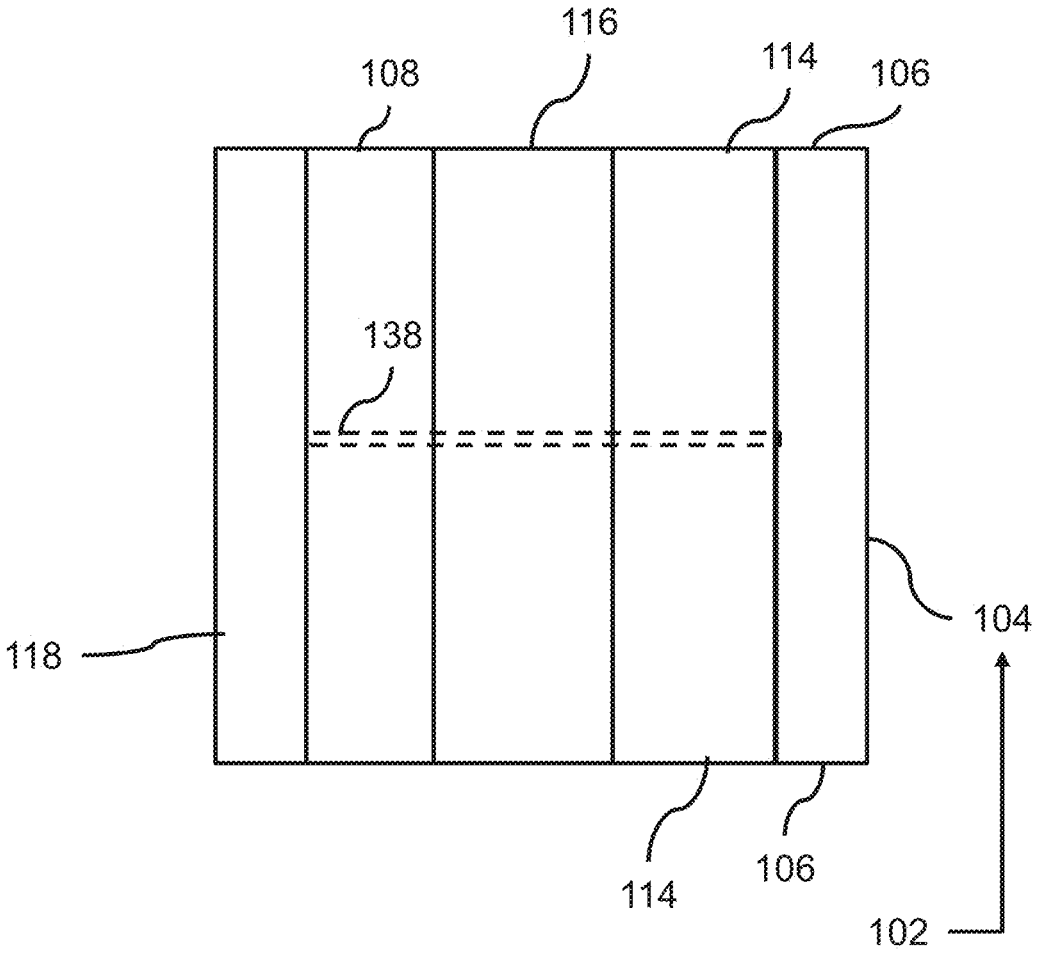

Referring to the embodiments as depicted in FIGS. 17 and 18 (in which a side view and a top view, respectively, are depicted), the box compartments 128 (or the container 108) includes a viewing material 118. The viewing material is configured to permit internal viewing, at least in part, of the box compartments 128 (or the containers 108). The normally-open sleeve compartment 132 includes a pivoting floor 136. The pivoting floor 136 is configured to pivot upwardly to a storage position in such a way that the normally-open sleeve compartment 132 may be collapsed when the normally-open sleeve compartment 132 is not used for storage of any items (thereby permitting relatively easier collapsing of the containers 108, when needed as such). The pivoting floor 136 includes, for instance, a rigid flat member, etc., and any equivalent thereof.

In accordance with an option, the normally-open sleeve compartment 132 includes a brace member 138. The brace member 138 spans across the normally-open sleeve compartment 132 from the front side to the rear side. The brace member 138 connects the front side to the rear side of the container 108 (such as, the normally-open sleeve compartment 132). The brace member 138 is configured to prevent the normally-open sleeve compartment 132 from sagging or gapping, etc., and to hold the normally-open sleeve compartment 132 in an open condition. The brace member 138 provides additional structural support for the normally-open sleeve compartment 132. It will be appreciated that the brace member 138 may be deployed on the container 108 (if so desired). In accordance with an option, at least some of the containers 108 may include the pivoting floor 136 configured to pivot upwardly to a storage position. In accordance with an option, at least some of the containers 108 include a brace member 138 configured to prevent the containers 108 from sagging.

Figure 19:
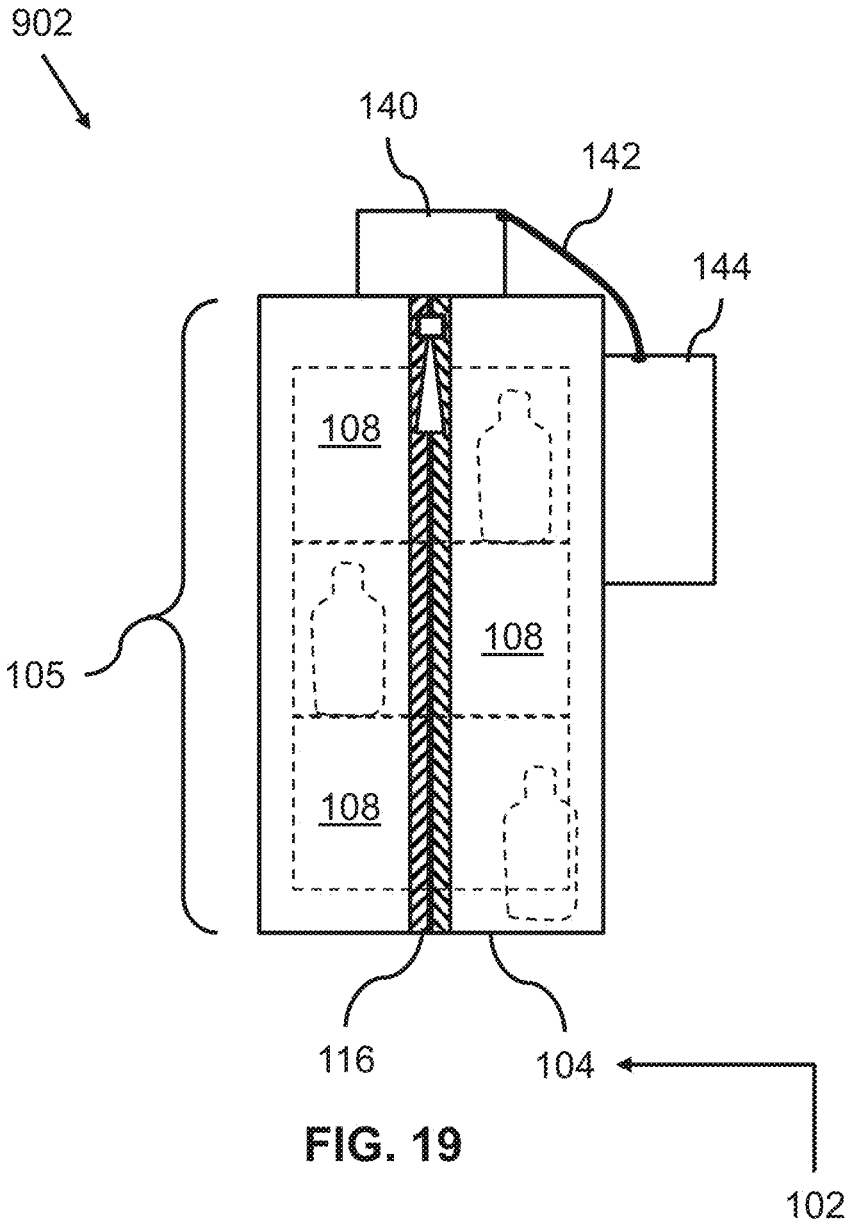

Referring to the embodiment as depicted in FIG. 19 (in which a side view is depicted), the travel luggage bag 102 includes a handle 140 extending from a top section of the travel luggage bag 102. The travel luggage bag 102 is depicted as forming the stack 105 (in the closed configuration 902).

The travel luggage bag 102 further includes a tether 142, and also further includes an auxiliary bag 144, in which the tether 142 is configured to securely couple the auxiliary bag 144 to the handle 140. The auxiliary bag 144 may be utilized for storage of vitamin pills, etc. The auxiliary bag 144 includes, for instance, a flexible fabric material (also called a web or a webbing) having any type of flexible material (natural or man-made, such as cotton, nylon, etc.). The auxiliary bag 144 may be waterproof.

FIGS. 20-23 depict views of embodiments of the travel luggage bag 102 of FIG. 1.

Figure 20:
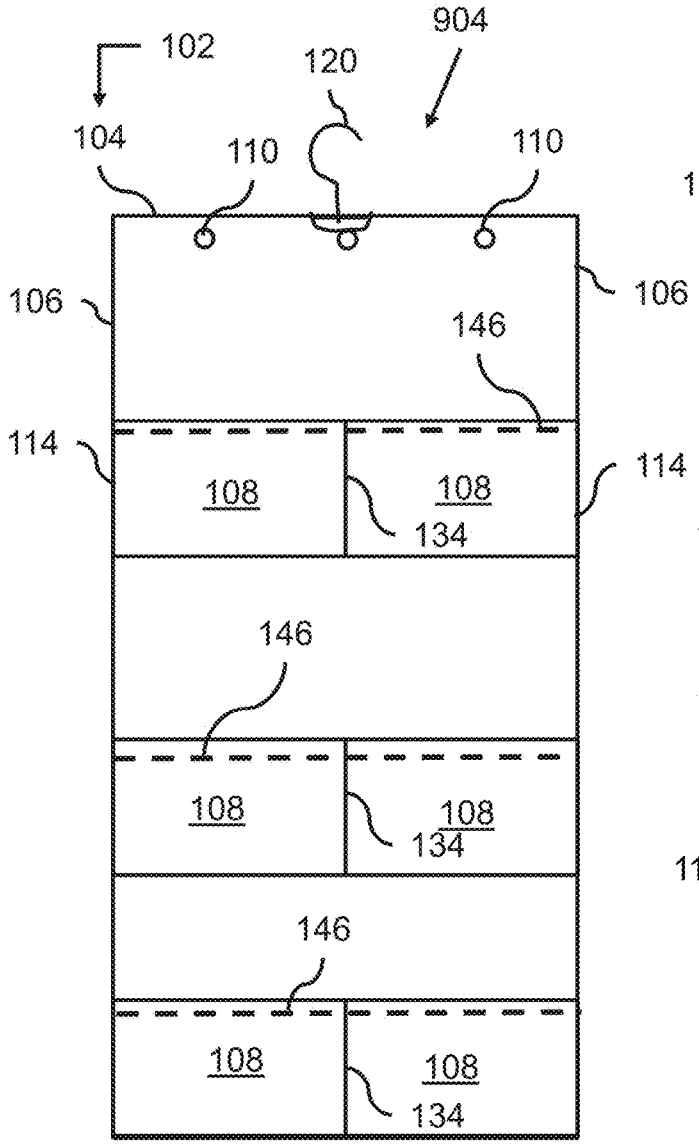
FIGS. 20-23 depict views of embodiments of the travel luggage bag of FIG. 1.
Figure 21:
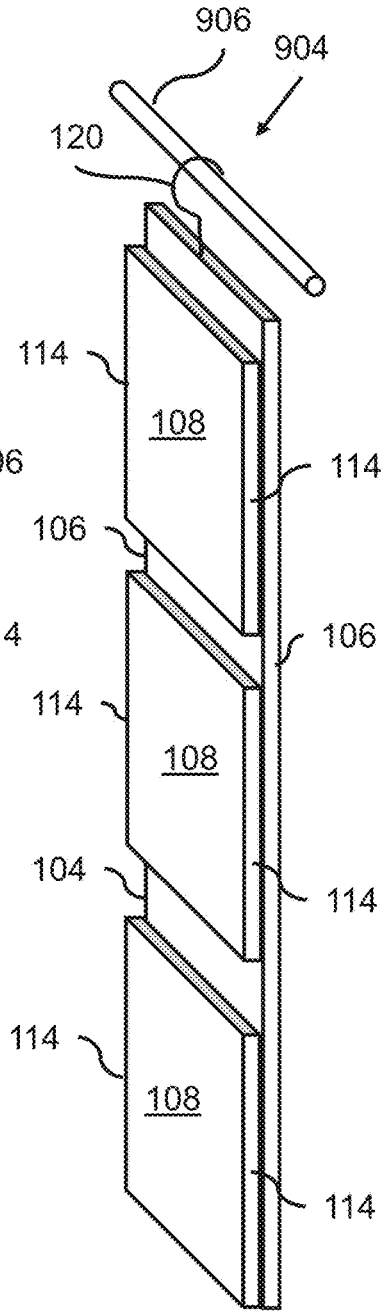

Referring to the embodiments as depicted in FIGS. 20 and 21 (in which a front view and a front perspective view, respectively, are depicted), the travel luggage bag 102 includes the containers 108 that are configured to receive and store garments (clean garments and/or soiled garments). At least one of the containers 108 include an elastic material 146. The elastic material 146 is configured to maintain the shape of the containers 108 once the containers 108 receive and store clothing.

Figure 22:
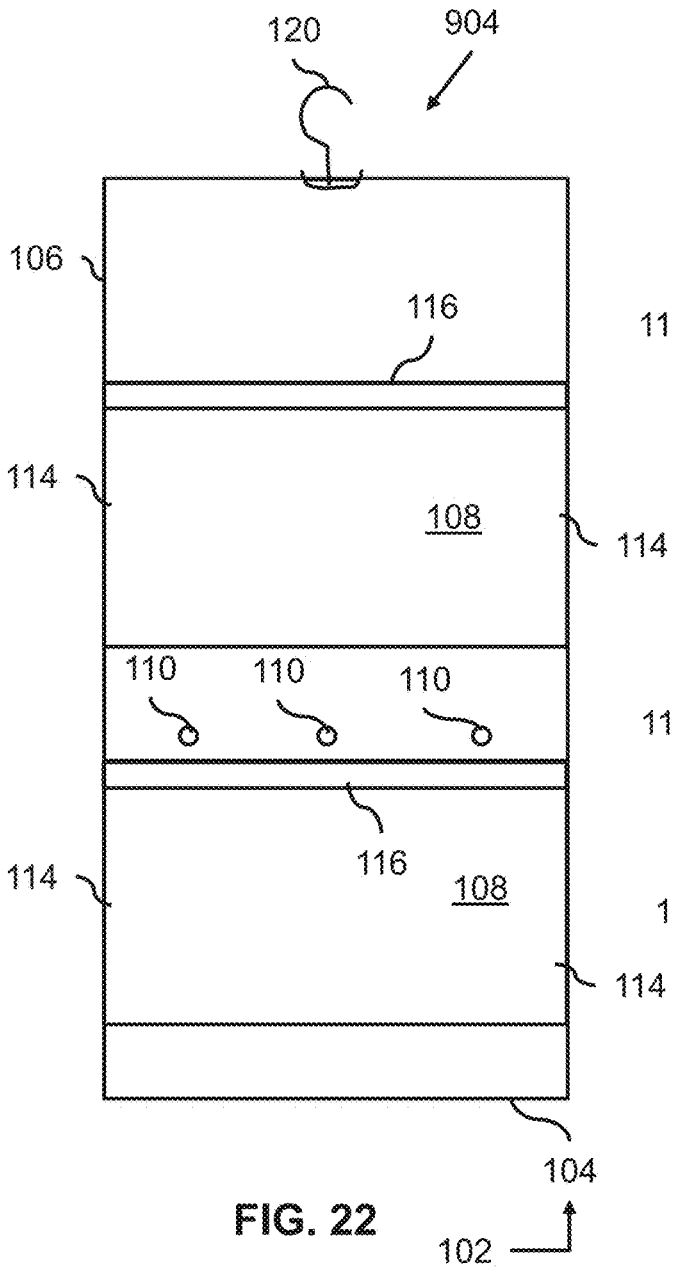
Figure 23:
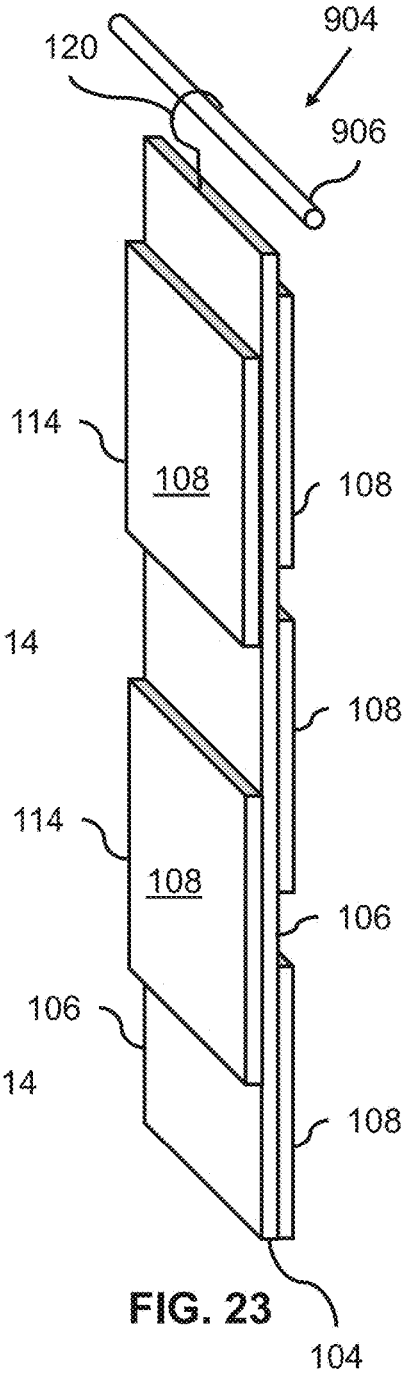

Referring to the embodiments as depicted in FIGS. 22 and 23 (in which a rear view and a rear perspective view, respectively, are depicted), the containers 108 are configured to receive and store garments. The containers 108 are positioned on opposite portions of the panel 104 for front storage and for rear storage of the garments. The containers 108 are positioned on, and fixedly attached to, the opposite sides of the panel 104 (the interior surface and the exterior surface of the elongated flexible foldable panel 104). Each of the containers 108 includes the container closure 116 (such as a zipper, etc.). The panel closure 110, preferably, includes magnets (a first magnet and a second magnet). Some of the containers 108 may be used for storing clean clothing, while other containers 108 may be used for storing dirty clothing.

FIGS. 24-28 depict views of embodiments of the travel luggage bag 102 of FIG. 1.

Figure 24:
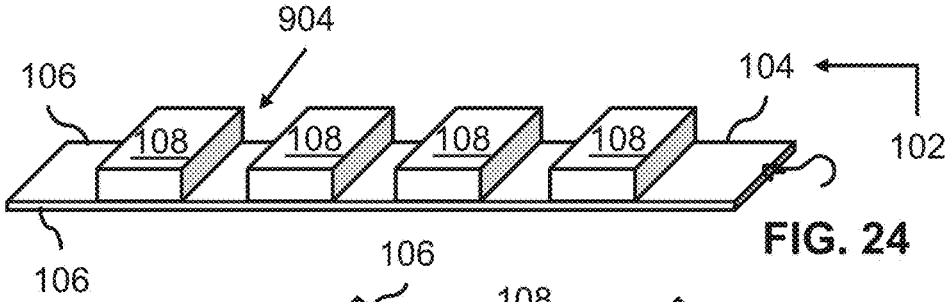
FIGS. 24-28 depict views of embodiments of the travel luggage bag of FIG. 1.

Referring to the embodiment as depicted in FIG. 24 (in which a side perspective view is depicted), the travel luggage bag 102 is preferably configured as a man's travel bag. The travel luggage bag 102 may be folded at a bathroom sink (if so desired), etc., and is not intended to be hung from a shower curtain (if so desired), etc. The containers 108 are positioned in a spaced-apart relationship, and are fixedly attached to one side of the elongated flexible foldable panel 104. As depicted, there are four instances of the containers 108 (preferably, all mounted to one side of the panel 104).

Figure 25:
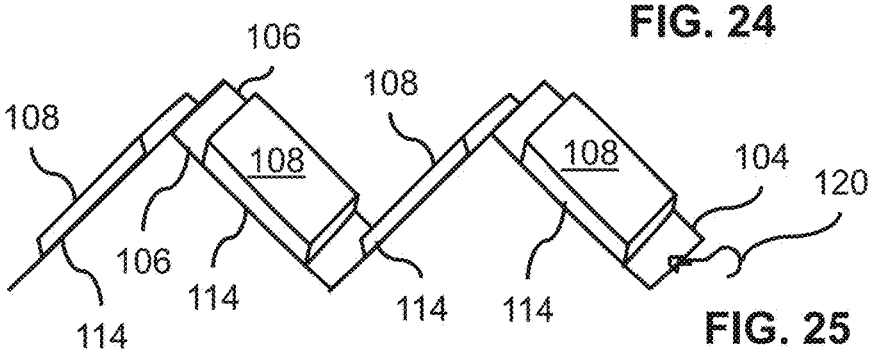

Referring to the embodiment as depicted in FIG. 25 (in which a side perspective view is depicted), the travel luggage bag 102 is configured to be contracted much like an accordion. In accordance with an option, the travel luggage bag 102 includes the open configuration 904 (if so desired).

Figure 26:
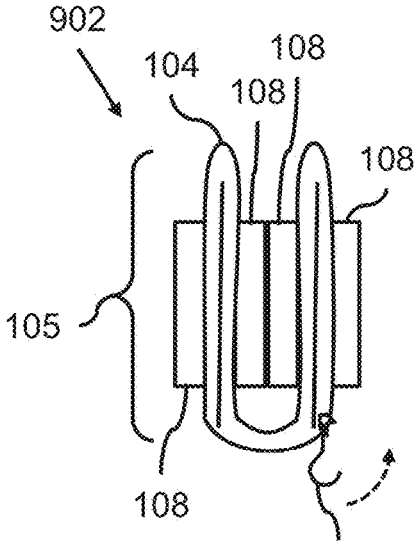

Referring to the embodiment as depicted in FIG. 26 (in which an end view is depicted), the travel luggage bag 102 is depicted in a compacted state (also called the closed configuration 902). The instances of the containers 108 are positioned in a coaxially-aligned relationship relative to each other (in the collapsed state). The panel 104 forms the stack 105. Portions of the panel 104 are folded against each other (in the collapsed state).

Figure 27:
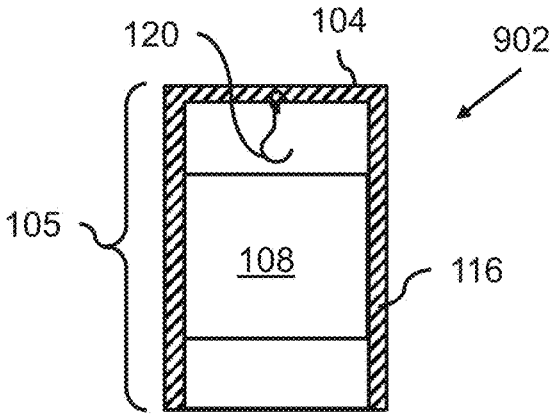

Referring to the embodiment as depicted in FIG. 27 (in which a front view is depicted), the container closure 116 is attached to a peripheral portion of the stack 105. The container closure 116 (such as a zipper, etc.) is configured to keep the instances of the containers 108 in the coaxially-aligned relationship relative to each other (in the collapsed state). The hanger mechanism 120 is configured to be pivotally positioned in a tucked position.

Figure 28:
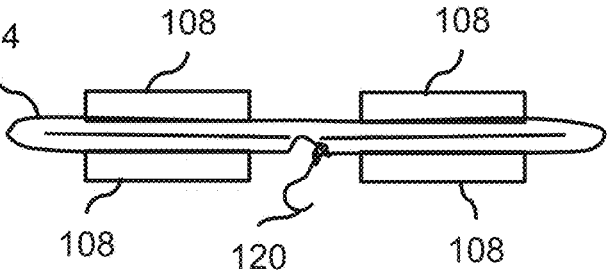

Referring to the embodiment as depicted in FIG. 28 (in which a side view is depicted), when needed, the user may unzip the zipper (as depicted in FIG. 27), and open a section of the travel luggage bag 102 so that oppositely positioned instances of the containers 108 may face the user. The travel luggage bag 102 may be positioned on a bathroom sink with the oppositely positioned instances of the containers 108 facing the user (if so desired).

FIGS. 29-33 depict views of embodiments of the travel luggage bag 102 of FIG. 1.

Figure 29:
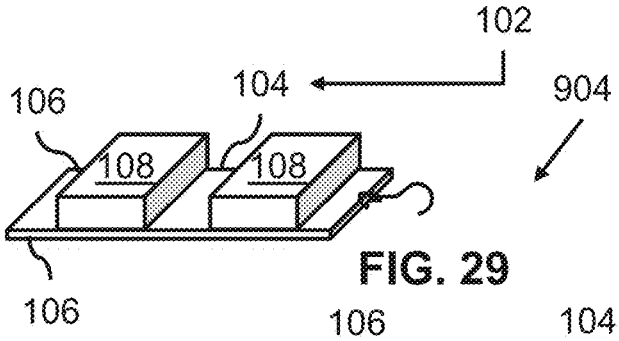
FIGS. 29-33 depict views of embodiments of the travel luggage bag of FIG. 1.

Referring to the embodiment as depicted in FIG. 29 (in which a side perspective view is depicted), the travel luggage bag 102 is preferably configured as a man's travel bag. The travel luggage bag 102 may be folded at a bathroom sink (if so desired), etc., and is not intended to be hung from a shower curtain (if so desired), etc. The containers 108 are positioned in a spaced-apart relationship, and are fixedly attached to one side of the elongated flexible foldable panel 104. As depicted, there are two instances of the containers 108 (preferably, all mounted to one side of the panel 104).

Figure 30:
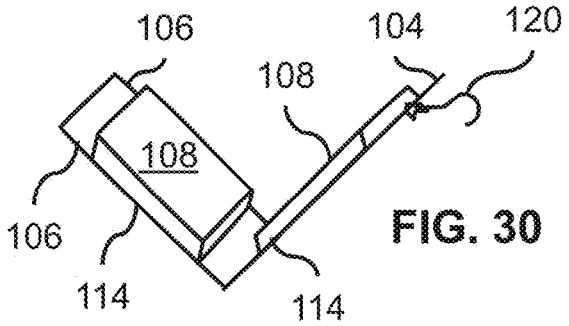

Referring to the embodiment as depicted in FIG. 30 (in which a side perspective view is depicted), the travel luggage bag 102 is configured to be contracted (folded) much like a book with a spine. In accordance with an option, the travel luggage bag 102 includes the open configuration 904 (if so desired).

Figure 31:
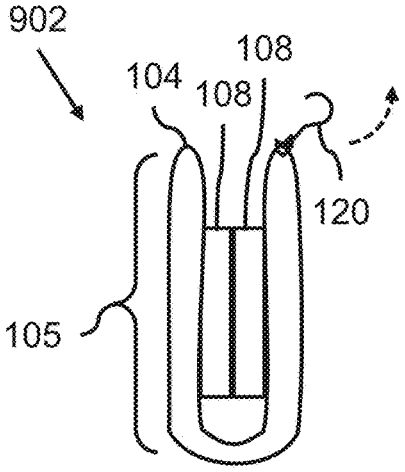

Referring to the embodiment as depicted in FIG. 31 (in which an end view is depicted), the travel luggage bag 102 is depicted in a compacted state (also called the closed configuration 902). The instances of the container 108 are positioned in a coaxially-aligned relationship relative to each other (in the collapsed state). The panel 104 forms the stack 105. Portions of the panel 104 are folded against each other (in the collapsed state).

Figure 32:
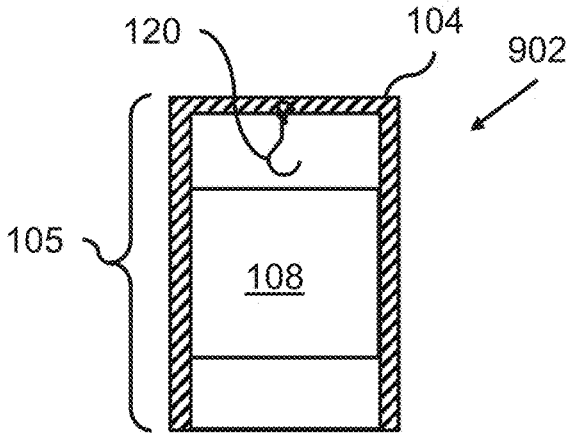

Referring to the embodiment as depicted in FIG. 32 (in which a front view is depicted), the container closure 116 is attached to a peripheral portion of the stack 105. The container closure 116 (such as a zipper, etc.) is configured to keep the instances of the container 108 in the coaxially-aligned relationship relative to each other (in the collapsed state). The hanger mechanism 120 is configured to be pivotally positioned in a tucked position.

Figure 33:
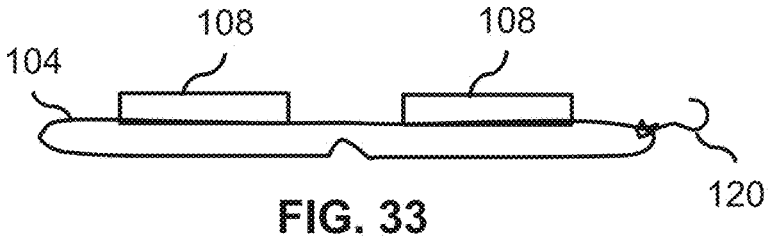

Referring to the embodiment as depicted in FIG. 33 (in which a side view is depicted), when needed, the user may unzip the zipper (as depicted in FIG. 32), and open a section of the travel luggage bag 102 so that oppositely positioned instances of the containers 108 may face the user. The travel luggage bag 102 may be positioned on a bathroom sink with the oppositely positioned instances of the containers 108 facing the user (if so desired).

It will be appreciated that the description and/or drawings identify and describe embodiments of the apparatus (either explicitly or non-explicitly). The apparatus may include any suitable combination and/or permutation of the technical features as identified in the detailed description, as may be required and/or desired to suit a particular technical purpose and/or technical function. It will be appreciated, that where possible and suitable, any one or more of the technical features of the apparatus may be combined with any other one or more of the technical features of the apparatus (in any combination and/or permutation). It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help understand the scope of the claims. It is believed that all the crucial aspects of the disclosed subject matter have been provided in this document. It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a travel luggage bag, including:

an elongated flexible foldable panel having spaced-apart elongated lateral panel sides extending between spaced-apart panel end portions; and the elongated flexible foldable panel including an exterior surface and an interior surface; and spaced-apart flexible containers being permanently attached to the interior surface of the elongated flexible foldable panel in such a way that (A) the spaced-apart flexible containers are each positioned to extend between the spaced-apart elongated lateral panel sides, and (B) the spaced-apart flexible containers are positioned, one following after another, between the spaced-apart panel end portions, wherein a last spaced-apart flexible container of the spaced-apart flexible containers touches an edge of a panel end portion of the spaced-apart panel end portions of the elongated flexible foldable panel; and the spaced-apart flexible containers being configured to receive and securely store a personal travel item; and the elongated flexible foldable panel being configured to be foldable in such a way that the elongated flexible foldable panel, in use, forms a stack of the spaced-apart flexible containers in a closed configuration, in which the spaced-apart flexible containers are user-inaccessible, and the exterior surface of the elongated flexible foldable panel is exposed while the interior surface of the elongated flexible foldable panel is concealed from viewing; and the stack of the spaced-apart flexible containers being unfoldable in the closed configuration to an open configuration; and in the open configuration, the elongated flexible foldable panel is unfolded and expanded, in which the spaced-apart flexible containers are readily user-accessible; and a panel closure being fixedly attached to the elongated flexible foldable panel, and the panel closure being configured to secure the elongated flexible foldable panel in the closed configuration; and the elongated flexible foldable panel having a length in the open configuration, in which the length of the elongated flexible foldable panel is folded in the closed configuration; and the spaced-apart flexible containers extending between the spaced-apart elongated lateral panel sides of the elongated flexible foldable panel; and the spaced-apart flexible containers having non-foldable user-accessible opposite sides and user-accessible opposite lateral container edges of the non-foldable opposite sides, the non-foldable user-accessible opposite sides from its respective user-accessible opposite lateral container edges extend perpendicularly from the spaced-apart elongated lateral panel sides of the elongated flexible foldable, in which the user-accessible opposite lateral container edges are respectively fixedly joined to the spaced-apart elongated lateral panel sides of the elongated flexible foldable panel, wherein the non-foldable user-accessible opposite sides provide height to the spaced-apart flexible containers and that the non-foldable user-accessible opposite sides are accessible to the user in the dosed configuration and in the open configuration of the elongated flexible foldable panel; and each of the spaced-apart flexible containers having a container closure being configured to securely close and open in such a way that the personal travel item is receivable therein once the elongated flexible foldable panel is placed in the open configuration, and the personal travel item is securely held therein once received therein; and wherein:

each of the spaced-apart flexible containers includes a user-inaccessible bottom portion, in which the user-inaccessible bottom portion extends between the user-inaccessible opposite lateral container edges of the spaced-apart flexible containers; and each of the spaced-apart flexible containers includes a user-accessible top portion, in which the user-accessible top portion extends between the user-accessible opposite lateral container edges of the spaced-apart flexible containers; and the user-accessible top portion of each spaced-apart flexible container of the spaced-apart flexible containers is positioned proximally above, and faces, the user-inaccessible bottom portion of a neighboring spaced-apart flexible container of the spaced-apart flexible containers once the elongated flexible foldable panel is unfolded, expanded and extended horizontally in the open configuration; and the user-accessible top portion of said each spaced-apart flexible container is user-accessible once the elongated flexible foldable panel is unfolded, expanded and extended horizontally in the open configuration in such a way that the personal travel item is receivable via the user-accessible top portion of said each spaced-apart flexible container and is securely held by said each spaced-apart flexible container; and the user-accessible top portion of said each spaced-apart flexible container is user-accessible once the elongated flexible foldable panel is unfolded, expanded and extended horizontally in the open configuration in such a way that the personal travel item is prevented from inadvertently falling out of the user-accessible top portion of said each spaced-apart flexible container once the personal travel item, in use, is received via the user-accessible top portion, and the elongated flexible foldable panel is unfolded, expanded and extended horizontally; and wherein the user-accessible opposite lateral container edges are always accessible, even if the elongated flexible foldable panel is folded; and backside pockets positioned on the exterior surface of the elongated flexible foldable panel, each of the back side pocket having a pocket closure, wherein the pocket closures of each of the back-side pocket face perpendicularly upward from the elongated flexible foldable panel such that a user is capable of accessing each of the back-side pocket from top side thereof, when the elongated flexible foldable panel is in the open or is the closed configuration.

2. The apparatus of claim 1, wherein:

the spaced-apart flexible containers include:

a viewing material configured to permit internal viewing, at least in part, of the spaced-apart flexible containers.

3. The apparatus of claim 1, wherein:

the elongated flexible foldable panel includes:

a hanger mechanism being connected to the elongated flexible foldable panel; and the hanger mechanism being configured to support vertical suspension of the elongated flexible foldable panel.

4. The apparatus of claim 1, wherein:

the elongated flexible foldable panel is continuous and uninterrupted between the spaced-apart panel end portions.

5. The apparatus of claim 1, wherein:

the spaced-apart flexible containers are permanently attached, at least in part, to the interior surface of the elongated flexible foldable panel.

6. The apparatus of claim 1, wherein:

the spaced-apart flexible containers are not folded in the closed configuration.

7. The apparatus of claim 1, wherein:

in the closed configuration, the exterior surface of the elongated flexible foldable panel is exposed while the interior surface of the elongated flexible foldable panel is concealed from user viewing; and in the open configuration, the exterior surface of the elongated flexible foldable panel is exposed and the interior surface of the elongated flexible foldable panel is also exposed for user viewing.

8. The apparatus of claim 1, wherein:

the elongated flexible foldable panel includes an item connector positioned on an inner surface of the elongated flexible foldable panel; and the item connector is located between adjacently positioned instances of the spaced-apart flexible containers.

9. The apparatus of claim 1, wherein:

the spaced-apart flexible containers are configured to collapse when items are removed from the spaced-apart flexible containers; and the spaced-apart flexible containers are also configured to expand when items are inserted into the spaced-apart flexible containers.

10. The apparatus of claim 1, wherein:

the spaced-apart flexible containers include a top container, a middle container, and a bottom container that are spaced apart from each other.

11. The apparatus of claim 1, wherein:

the panel closure includes:

a first magnet mounted on the rear side of the elongated flexible foldable panel; and a second magnet mounted on the rear side of the elongated flexible foldable panel, and the second magnet is configured to be magnetically attracted to the first magnet.

12. The apparatus of claim 1, wherein:

the spaced-apart flexible containers include:

box compartments positioned in a vertically-aligned row.

13. The apparatus of claim 1, wherein:

the spaced-apart flexible containers include:

a normally-closed sleeve compartment; and the normally-closed sleeve compartment extending between the spaced-apart elongated lateral panel sides of the elongated flexible foldable panel; and the normally-closed sleeve compartment having opposite flexible lateral sides that touch each other when no item is received in the normally-closed sleeve compartment.

14. The apparatus of claim 1, wherein:

the spaced-apart flexible containers include:

a normally-open sleeve compartment configured to remain normally open when the normally-open sleeve compartment does not receive an item.

15. The apparatus of claim 1, wherein:

the spaced-apart flexible containers include:

a divider portion positioned in at least one of the spaced-apart flexible containers.

16. The apparatus of claim 1, wherein:

the spaced-apart flexible containers include:

a pivoting floor configured to pivot upwardly to a storage position.

17. The apparatus of claim 1, wherein:

the spaced-apart flexible containers include:

a brace member configured to prevent the spaced-apart flexible containers from sagging.

18. The apparatus of claim 1, wherein:

the travel luggage bag includes:

a handle extending from a top section of the travel luggage bag; and a tether; and an auxiliary bag, in which the tether is configured to securely couple the auxiliary bag to the handle.

* * * * *